US009145900B2

(12) United States Patent
Kim et al.

(10) Patent No.: US 9,145,900 B2
(45) Date of Patent: Sep. 29, 2015

(54) AIR BLOWER FOR AN AIR CONDITIONER

(75) Inventors: Jung Hoon Kim, Changwon-Si (KR); Dong Soo Moon, Changwon-si (KR); Jung Woo Lee, Changwon-si (KR); Mi Jin Jung, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 538 days.

(21) Appl. No.: 13/308,806

(22) Filed: Dec. 1, 2011

(65) Prior Publication Data

US 2012/0141262 A1 Jun. 7, 2012

(30) Foreign Application Priority Data

Dec. 3, 2010 (KR) ..... 10-2010-0122847

(51) Int. Cl.
*F04D 29/42* (2006.01)
*F04D 29/44* (2006.01)

(52) U.S. Cl.
CPC ..... *F04D 29/441* (2013.01); *F04D 29/4226* (2013.01); *F04D 29/4233* (2013.01)

(58) Field of Classification Search
USPC ..... 415/182.1, 203, 204, 206, 207, 212.1, 415/224
See application file for complete search history.

(56) References Cited

U.S. PATENT DOCUMENTS

| | | | | |
|---|---|---|---|---|
| 6,881,031 | B2 | 4/2005 | Nomura | |
| 7,220,101 | B2 * | 5/2007 | Chen et al. | 415/204 |
| 7,591,633 | B2 * | 9/2009 | Hancock | 415/206 |
| 2006/0165521 | A1 * | 7/2006 | Kim | 415/204 |

FOREIGN PATENT DOCUMENTS

| | | | |
|---|---|---|---|
| CN | 1282844 | A | 2/2001 |
| CN | 1573125 | A | 2/2005 |
| CN | 200982316 | Y | 11/2007 |
| CN | 100504075 | C | 6/2009 |
| CN | 101338770 | B | 8/2010 |

* cited by examiner

*Primary Examiner* — Dwayne J White
*Assistant Examiner* — Justin Seabe
(74) *Attorney, Agent, or Firm* — Dentons US LLP

(57) ABSTRACT

Provided is an air blower for an air conditioner. The air blower for the air conditioner includes a centrifugal fan and a fan housing. The fan housing covers the centrifugal fan, and forms a scroll-type flow path having a varying cross-sectional area and guiding air forcibly blown by the centrifugal fan to an outlet. Here, a bottom surface of the scroll-type flow path inclines and is thinnest near a region where the scroll-type flow path ends. The thickness of the bottom surface progressively increases along a straight line running from a region where the bottom surface is thinnest to an opposite outer side of the scroll-type flow path through a center of the centrifugal fan.

12 Claims, 9 Drawing Sheets

AIR BLOWER FOR AN AIR CONDITIONER

CROSS-REFERENCE TO RELATED APPLICATION

This application claims priority from Korean Patent Application No. 10-2010-0122847 filed on Dec. 3, 2010 in the Korean Intellectual Property Office, the disclosure of which is incorporated herein by reference in its entirety.

BACKGROUND OF THE INVENTION

1. Field of the Invention

The present invention relates to an air blower for an air conditioner, and more particularly, to an air blower for an air conditioner having an extended flow path cross-sectional area at the side of the outlet by obliquely forming the bottom surface of a fan housing covering a centrifugal fan.

2. Description of the Related Art

In general, an air conditioner is an apparatus that provides users with a more pleasant indoor environment by cooling/heating an indoor space using a refrigeration cycle for refrigerant, constituted by a compressor, condenser, expansion unit, and an evaporator, or by filtering indoor air.

Such an air conditioner includes an air blower for discharging air heat-exchanged by a heat exchanger. The air blower includes a centrifugal fan for forcibly blowing air suctioned from an axial direction in a circumferential direction, and a fan housing covering the centrifugal fan.

The air forcibly blown by the centrifugal fan is guided through a flow path formed in the fan housing to be discharged. In a related art air blower, however, the flow path formed in the fan housing is not sufficiently expanded as it approaches the outlet. This causes a surging phenomenon, which may cause a flow rate loss and an increase in noise.

SUMMARY OF THE INVENTION

An object of the present invention is to provide an air blower for an air conditioner that increases the amount of discharged air and reduces noise, by sufficiently expanding an internal flow path of a fan housing guiding air forcibly blown by a centrifugal fan as it approaches an outlet.

According to an aspect of the present invention, there is provided an air blower for an air conditioner, comprising: a centrifugal fan; and a fan housing covering the centrifugal fan, and forming a scroll-type flow path having a varying cross-sectional area and guiding air forcibly blown by the centrifugal fan to an outlet, wherein a bottom surface of the scroll-type flow path inclines and is thinnest near a region where the scroll-type flow path ends, and a thickness of the bottom surface progressively increases along a straight line running from a region where the bottom surface is thinnest to an opposite outer side of the scroll-type flow path through a center of the centrifugal fan.

The cross-sectional area of the scroll-type flow path progressively may increases in a flow direction from a cut-off region where the scroll-type flow path starts to the region where the scroll-type flow path ends.

The bottom surface of the scroll-type flow path may incline at a certain inclination angle.

The air blower for the air conditioner may further include a discharging flow path extending from the region where the scroll-type flow path ends to the outlet, wherein the bottom surface of the discharging flow path has the same inclination angle as the scroll-type flow path.

The thickness of the bottom surface of the scroll-type flow path may become greatest at a point having a certain scroll angle with respect to a cut-off region where the scroll-type flow path starts.

According to another aspect of the present invention, there is provided an air blower for an air conditioner, comprising: a centrifugal fan; and a fan housing covering the centrifugal fan, and forming a scroll-type flow path having a varying cross-sectional area and guiding air forcibly blown by the centrifugal fan to an outlet, wherein a bottom surface of the scroll-type flow path is formed by processing an inclination surface, and has a thinner thickness a region where the scroll-type flow path ends than a thickness at a cut-off region where the scroll-type flow path starts.

The bottom surface of the scroll-type flow path may be formed by processing an inclination surface inclined at a certain inclination angle.

The air blower for the air conditioner may further include a discharging flow path extending from the region where the scroll-type flow path ends to the outlet, wherein the bottom surface of the discharging flow path has the same inclination angle as the scroll-type flow path.

The cross-sectional area of the scroll-type flow path may progressively increase in a flow direction from the cut-off region to the region where the scroll-type flow path ends.

According to another aspect of the present invention, there is provided an air blower for an air conditioner, comprising: a centrifugal fan; and a fan housing covering the centrifugal fan, and forming a scroll-type flow path having a varying cross-sectional area and guiding air forcibly blown by the centrifugal fan to an outlet, wherein a height of the scroll-type flow path progressively increases from upstream to downstream in the scroll-type flow path, and an amount of discharged air increases by an amount corresponding to an increment of the flow path sectional area due to an increase of the height of the scroll-type flow path.

The bottom surface of the scroll-type flow path may inclines, and the height of the scroll-type flow path may becomes greatest at a region adjacent to where the scroll-type flow path ends, and may be progressively reduced along a straight line connecting from a point where the height of the scroll-type flow path is greatest to an opposite outer side of the scroll-type flow path through a center of the centrifugal fan.

The cross-sectional area of the scroll-type flow path may progressively increase along a flow direction from a cut-off region where the scroll-type flow path starts to a region where the scroll-type flow path ends.

The height of the scroll-type flow path may be reduced at a certain ratio along a straight line connecting from a point where the height of the scroll-type flow path is greatest to an opposite outer side of the scroll-type flow path through a center of the centrifugal fan.

The air blower for the air conditioner may further include a discharging flow path extending from a location where the scroll-type flow path ends to the outlet. Here, a height of the discharging flow path is continuously connected to the height of the scroll-type flow path.

BRIEF DESCRIPTION OF THE DRAWINGS

The features and advantages of the present invention will become more apparent from reading the Detailed Description of the Invention which makes reference to the attached drawings in which.

DETAILED DESCRIPTION OF THE INVENTION

Figure 1:
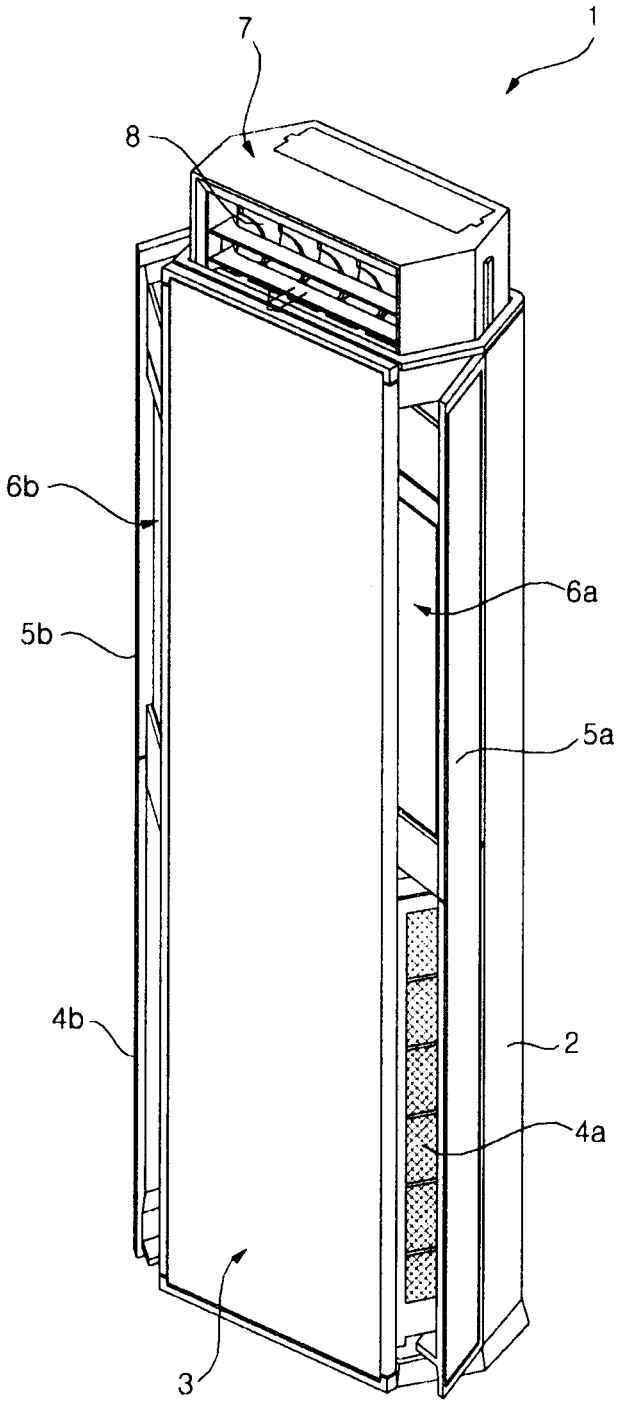
FIG. 1 is a view illustrating an air conditioner.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. Like reference numerals in the drawings denote like elements.

FIG. 1 illustrates an air conditioner. Referring to FIG. 1, an air conditioner 1 may include a casing 2, a front panel 3 provided on the front surface of the casing 2, and a rise and fall unit 7 rising and falling along the casing 2 and including a forward discharging portion 8 discharging air in a forward direction.

Air suction portions 4*a* and 4*b* may be formed at both sides of the casing 2. The air suction portions 4*a* and 4*b* may be opened/closed by vanes 5*a* and 5*b* rotatably installed in the casing 2. The vanes 5*a* and 5*b* may be provided with side surface discharging portions (not shown) discharging air. The side surface discharging portions may be opened/closed by outlet covers 6*a* and 6*b* rotatably provided in the vanes 5*a* and 5*b*.

The air conditioner 1 described above may include an air blower in the casing 2. Since the air blower has to blow air suctioned through the air suction portions 4*a* and 4*b* to the side surface discharging portion formed in the vanes 5*a* and 5*b* and/or the forward discharging portion 8 formed in the rise and fall unit 7, a centrifugal fan may be advantageous for the air blower.

An air blower 100 for an air conditioner that is described below according to an embodiment of the present invention may be applied to the air conditioner 1 described above with reference to FIG. 1 and other various kinds of air conditioners.

Figure 2:
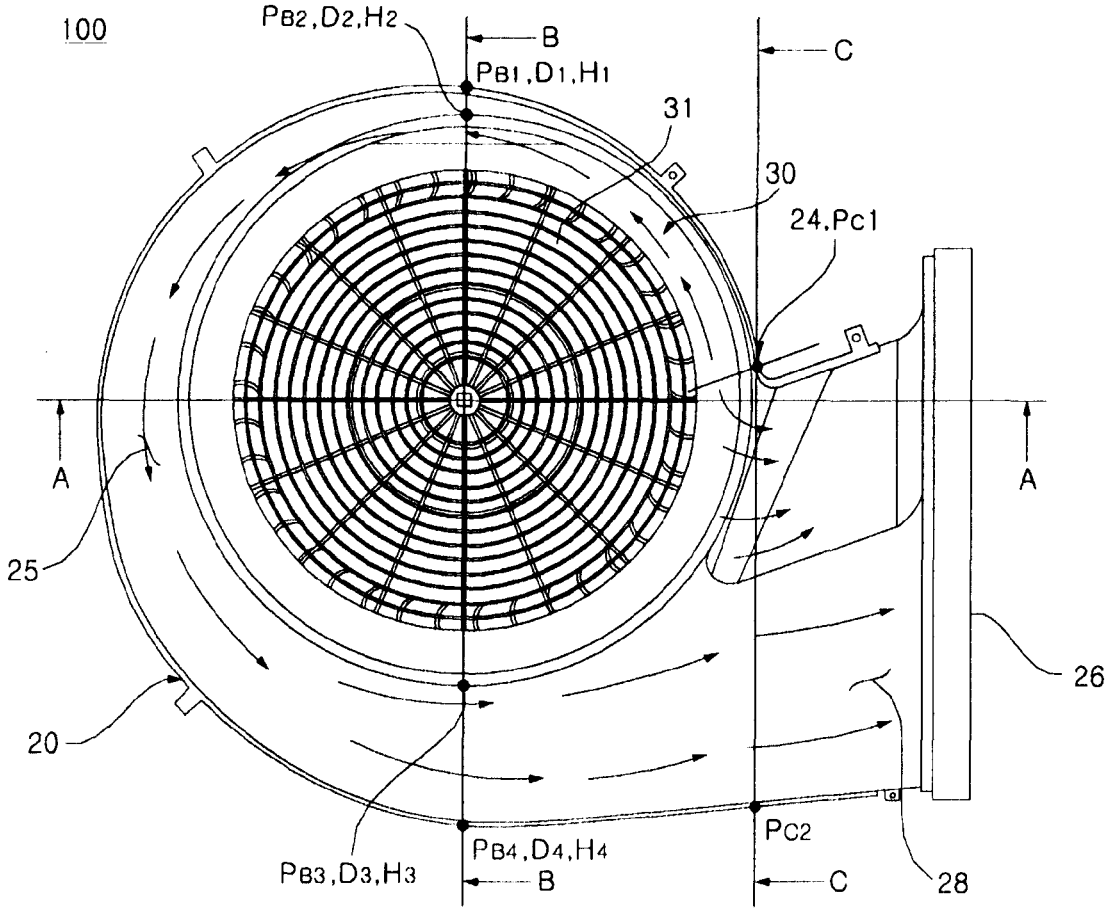
FIG. 2 is a view illustrating an air blower according to an embodiment.
Figure 3A:
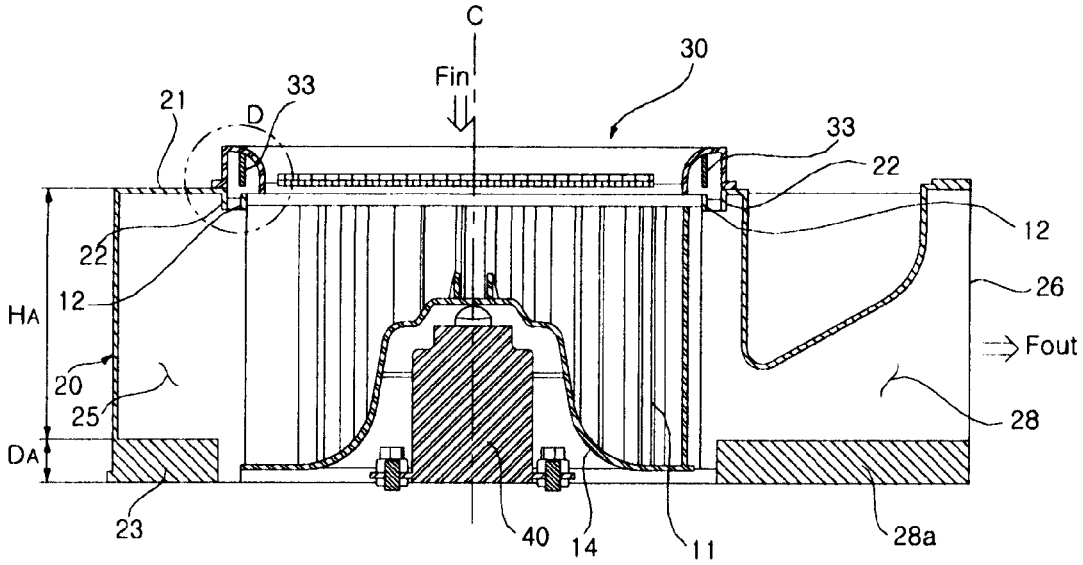
FIG. 3A is a cross-sectional view taken along line A-A of FIG. 2.
Figure 3B:
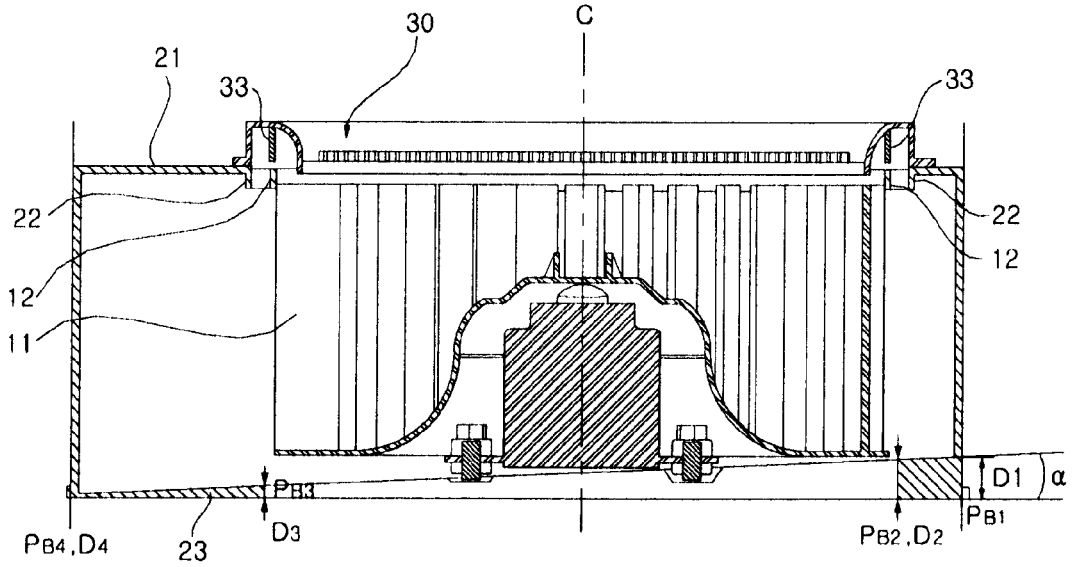
FIG. 3B is a cross-sectional view taken along line B-B of FIG. 2.
Figure 3C:
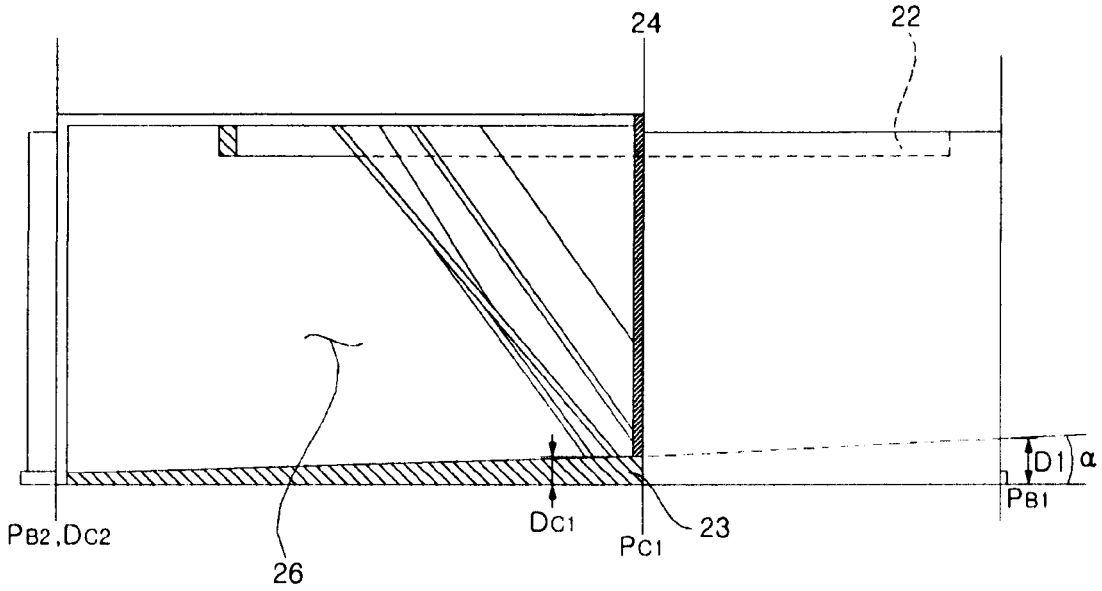
FIG. 3C is a cross-sectional view taken along C-C of FIG. 2.
Figure 4:
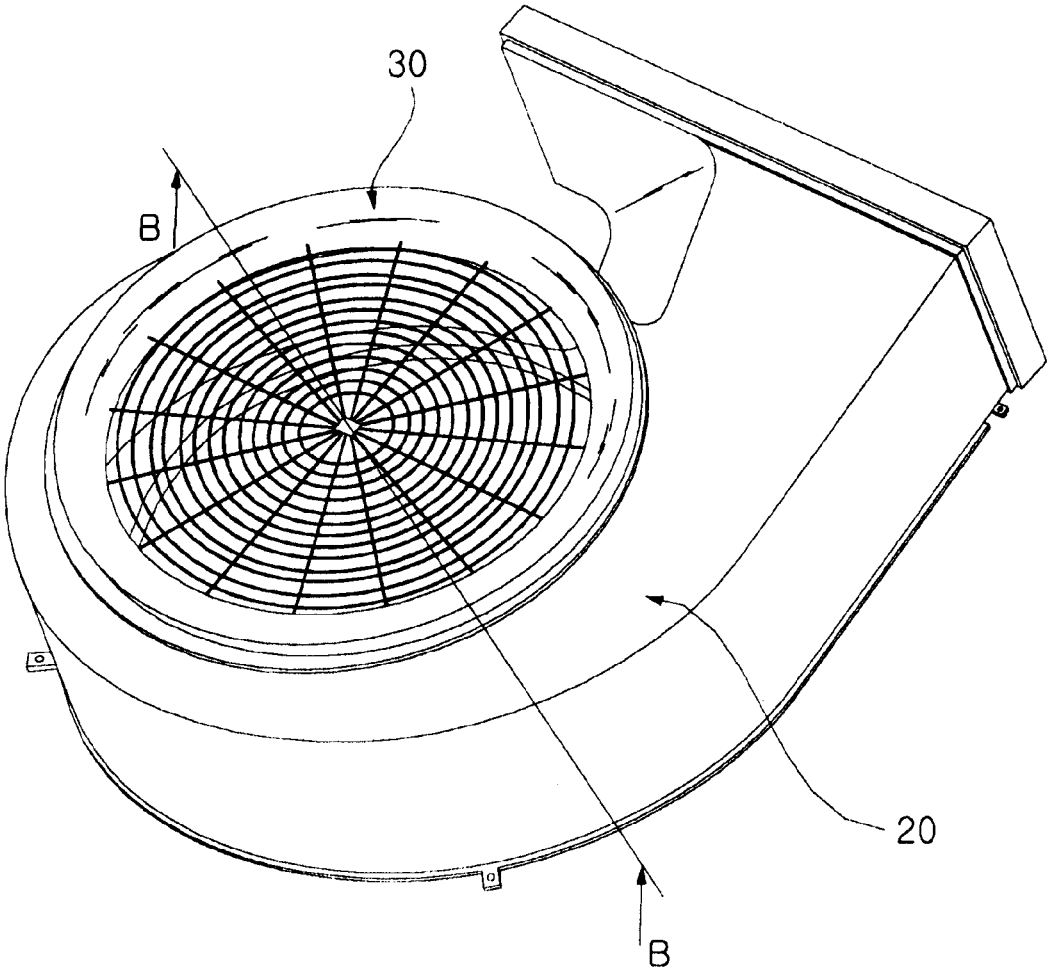
FIG. 4 is a perspective view illustrating a fan housing of FIG. 2.
Figure 5:
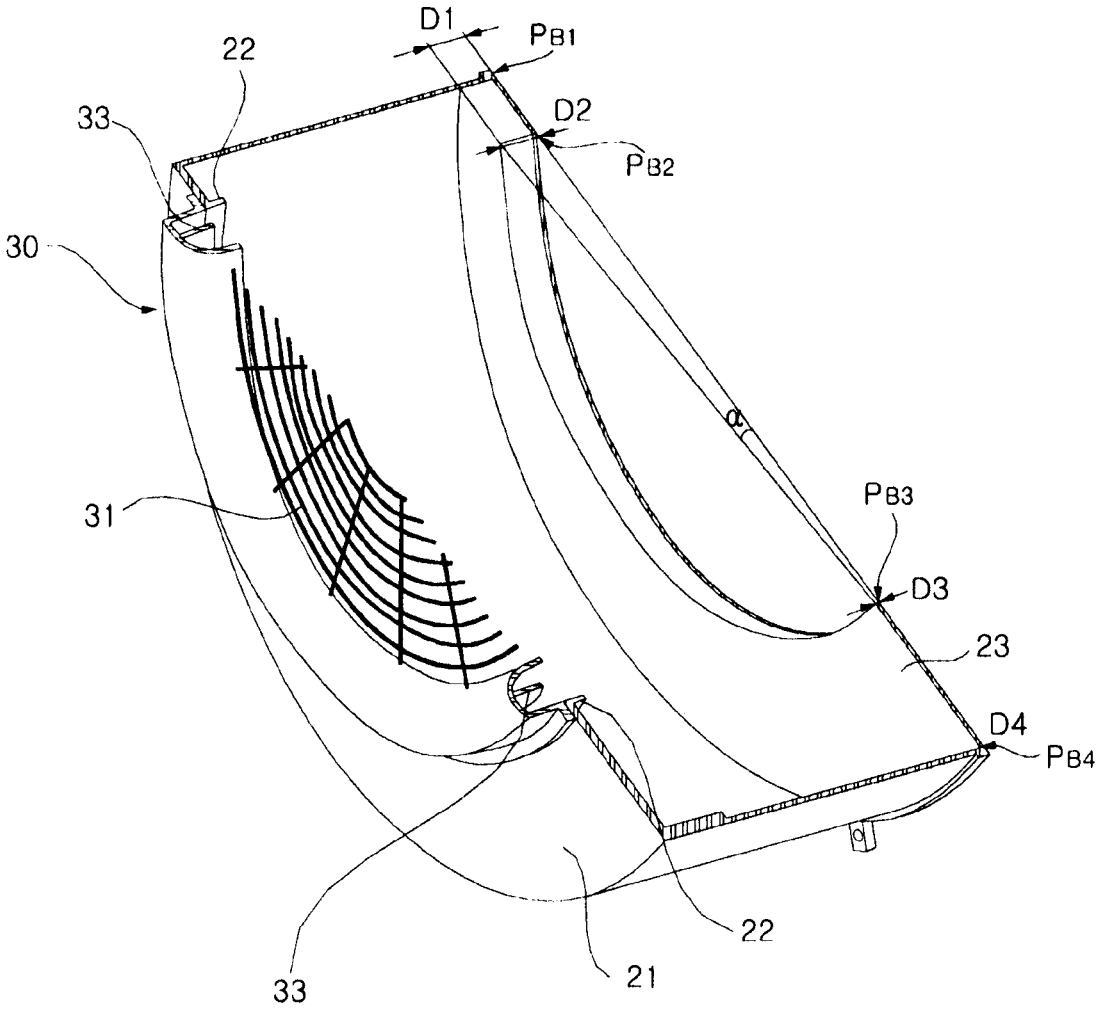
FIG. 5 is a cross-sectional view taken along line B-B of FIG. 4.
Figure 6:
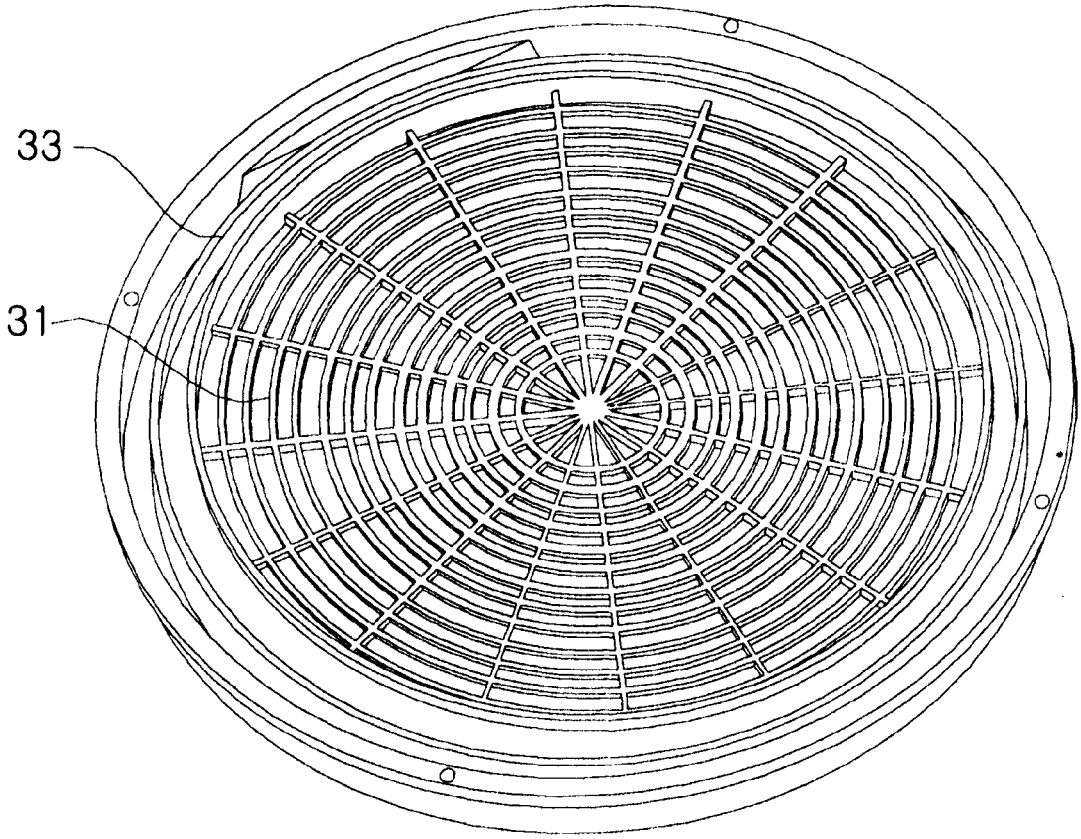
FIG. 6 is a perspective view illustrating a rear surface of a bell-mouth of FIG. 5.
Figure 7:
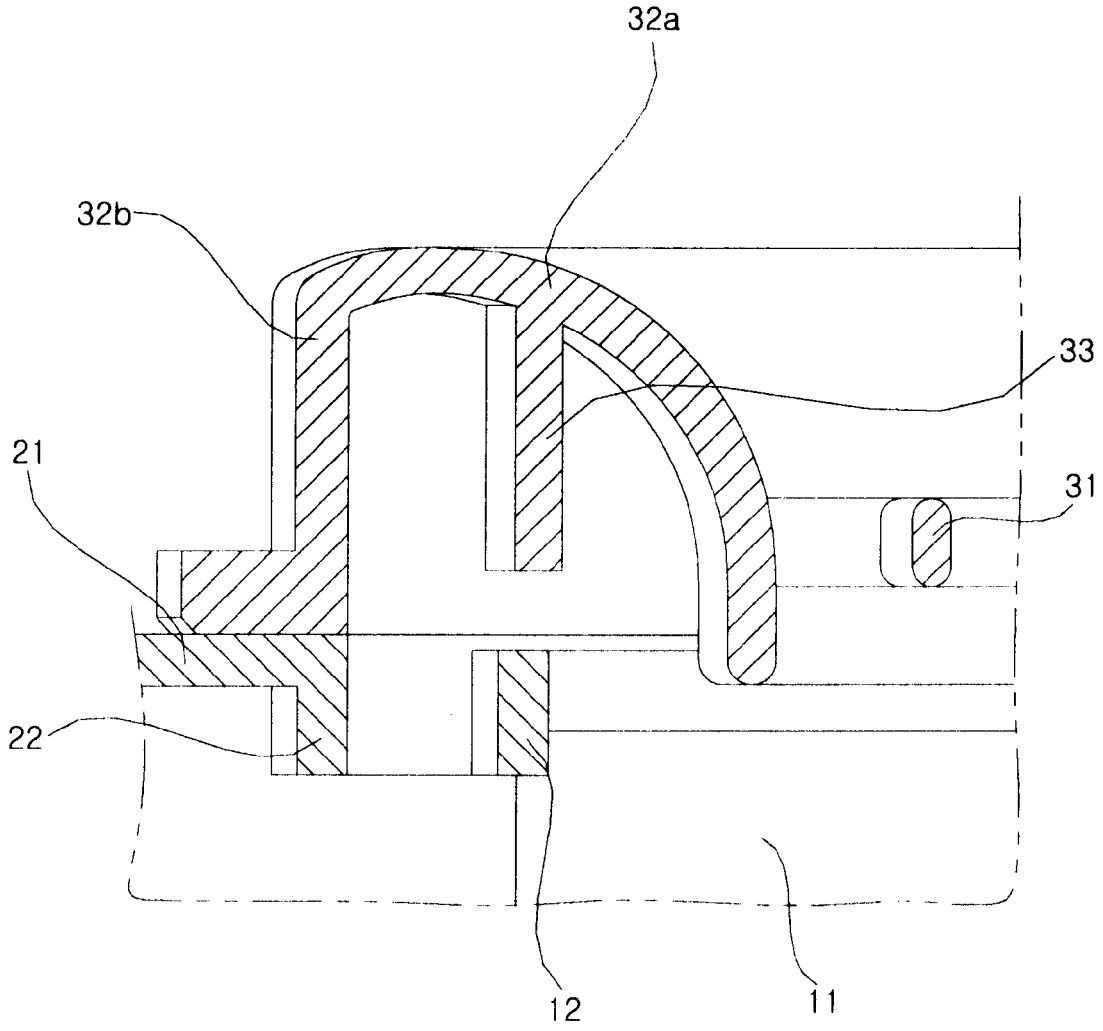
FIG. 7 is a magnified cross-sectional view illustrating a portion D of FIG. 3A.

FIG. 2 is a view illustrating an air blower according to an embodiment. FIG. 3A is a cross-sectional view taken along line A-A of FIG. 2. FIG. 3B is a cross-sectional view taken along line B-B of FIG. 2. FIG. 3C is a cross-sectional view taken along C-C of FIG. 2. FIG. 4 is a perspective view illustrating a fan housing of FIG. 2. FIG. 5 is a cross-sectional view taken along line B-B of FIG. 4. FIG. 6 is a perspective view illustrating a rear surface of a bell-mouth of FIG. 5. FIG. 7 is a magnified cross-sectional view illustrating a portion D of FIG. 3A.

Referring to FIG. 2, an air blower 100 for an air conditioner according to an embodiment of the present invention may include a centrifugal fan 100 suctioning air from an axial direction and discharging the air in a radial direction, a bell-mouth 30 guiding air to the centrifugal fan 10, and a fan housing 20 covering the centrifugal fan 10 and guiding the air forcibly blown by the centrifugal fan 10 to an outlet 26. In FIG. 3A, an axial flow suctioned into the centrifugal fan 10 is indicated as Fin, and a flow discharged through the outlet 26 is indicated as Fout.

The centrifugal fan 10 may include a motor 40, a hub 14 coupled to a driveshaft rotated by the motor 40, a plurality of wings 11 disposed on the hub 14 in a radial pattern, and a rim 12 connecting ends of the plurality of wings 11 to each other. The rim 12 may serve to prevent the wing 11 from deforming or being dislodged by high-speed rotation.

Air may be guided to the centrifugal fan 10 along the top surface of the bell-mouth 30. The bell-mouth 30 may have a ring shape, the diameter of which is reduced progressively toward an outlet end disposed toward the centrifugal fan 10. Accordingly, the sectional shape of the bell-mouth 30 may include a bending portion 32*a* as shown in FIG. 7, and a side wall portion 32*b* extending from the outer circumference of the bending portion 32*a* may be coupled along the circumference of an opening of the fan housing 20.

On the other hand, a grill 31 may be provided to prevent foreign materials entering from outside. The grill 31 may be integrally formed with the bell-mouth 30, or may be coupled to the bell-mouth 30 as a separate component.

The fan housing 20 may be formed as a scroll-type housing in which the flow path is diffused progressively toward the outlet 26. Along a cut-off region 24, a portion of air forcibly blown by the centrifugal fan 10 may be directly discharged through the outlet 26, and the other portion of air may be guided along the scroll-type flow path 25, and then discharged through the outlet 26. That is, the cut-off region 24 may be defined as a starting point at which airflow forcibly blown by the centrifugal fan 10 is branched to flow along the scroll-type flow path 25.

The scroll-type flow path 25 in the fan housing 20 may form an expansion pattern in which a flow path radius progressively increases from the cut-off region 24. The flow path radius may denote a distance from the center C of the centrifugal fan 10 to the circumference of the fan housing 20.

A discharging flow path 28 may connect the scroll-type flow path 25 and the outlet 26. The bottom surface 28*a* of the discharging flow path 28 may have the same inclination angle as the bottom surface 23 of the scroll-type flow path, and may run in a straight line from a portion at which the scroll-type flow path 25 ends and extend to the outlet 26. Accordingly, the bottom surface 28*a* of the discharging flow path 28 may have the same thickness as the point at which the scroll-type flow path 25 ends, and the discharging flow path 28 may also have the same height as the height of the flow path at the point at which the scroll-type flow path 25 ends.

That is, the discharging flow path 28 may extend from the scroll-type flow path 25, and the bottom surface 28*a* of the discharging flow path 28 may have the same inclination angle as the bottom surface 23 of the scroll-type flow path. Also, the discharging flow path 28 may have the same height as the scroll-type flow path 25.

The fan housing 20 may have a first inlet inside the bottom surface 23 of the scroll-type flow path to suction air, and a second inlet on the top surface 21 to face the first inlet. Air suctioned to the center portion of the centrifugal fan 10 through the first and second inlets may be discharged between the wings 11. A portion of the discharged air may be directly guided to the outlet 26 at the cut-off region 24, and the other portion of the discharged air may be guided to the outlet 26 along the scroll-type flow path 25 in the fan housing 20.

The bottom surface 23 of the scroll-type flow path may be formed to have an inclination surface by which its thickness is progressively changed. Referring to FIGS. 2 and 3B, the bottom surface 23 of the scroll-type flow path may be thinnest at a location adjacent to where the scroll-type flow path 25 ends. At $P_{B4}$ in the present invention, the thickness of the bottom surface 23 of the scroll-type flow path may become smallest as $D_4$. In this case, the thickness of the scroll-type flow path 25 may become greatest as $D_1$ at a point $P_{B1}$ at which a straight line extending from $P_{B4}$ and passing the center of the centrifugal fan 10 meets the opposite outer side of the scroll-type flow path 25.

The bottom surface 23 of the scroll-type flow path may be fainted to have a certain inclination angle. In this case, the thickness of the bottom surface 23 of the scroll-type flow path may be progressively reduced at a certain rate from the point $P_{B1}$ to the point $P_{B4}$. Hereinafter, the inclination angle is calls an inclination $\alpha$. That is, referring to FIG. 3B, while passing points $P_{B1}$, $P_{B2}$, $P_{B3}$ , and $P_{B4}$ along the straight line (line B-B of FIG. 2) passing through the center of the centrifugal fan 10, the thickness of the bottom surface 23 of the scroll-type flow path may be gradually reduced at a certain rate of $D_1$, $D_2$, $D_3$, and $D_4$.

On the other hand, when a distance between the bottom surface 23 and the top surface 21 is defined as the height of the scroll-type flow path 25, the height of the scroll-type flow path 25 may progressively increase from upstream to downstream in the scroll-type flow path 25. That is, the height of the scroll-type flow path 25 may progressively increase from the cut-off region 24 of FIG. 2 along the flow direction of the scroll-type flow path 25. Accordingly, the flow rate may increase by an increment of the flow path sectional area according to the height of the scroll-type flow path 25.

More specifically, the height of the scroll-type flow path 25 may become greatest near the point at which the scroll-type flow path 25 ends. In the present invention, the height of the scroll-type flow path 25 may become greatest $H_4$ at the point $P_{B4}$, and may become smallest $H_1$ at the point $P_{B1}$ at which the straight line extending from the point $P_{B4}$ and passing the center of the centrifugal fan 10 meets the opposite outer side of the scroll-type flow path 25. Accordingly, due to a difference between a height of scroll-type flow path 25 at the point $P_{B4}$ and a height of scroll-type flow path 25 at the point $P_{B1}$ the sectional area of the scroll-type flow path 25 may increase from the point $P_{B1}$ to the point $P_{B4}$, and the flow rate of air discharged from the point $P_{B4}$ may increase by an increment of the sectional area.

As described above, the height of the scroll-type flow path 25 may progressively increase as it passes the points $P_{B1}$, $P_{B2}$, $P_{B3}$, and $P_{B4}$, which are points on the straight line passing the center of the centrifugal fan 10. When the bottom surface 23 of the scroll-type flow path 25 is formed by processing an inclination surface having a certain inclination angle, the height of the scroll-type flow path 25 may linearly increase.

Referring to FIG. 3A, the bottom surface 23 of the scroll-type flow path 25 inclines at a certain inclination angle, the thickness of the bottom surface 23 of the scroll-type flow path 25 may appear to have a constant thickness $D_A$ in the cross-section view taken along line A-A that is perpendicular to the inclination direction of the bottom surface 23 of the scroll-type flow path 25 (See FIG. 3A). Similarly, no matter how it is taken along a certain line parallel to the line A-A of FIG. 2, the cross-section of the bottom surface 23 of the scroll-type flow path 25 may appear to be have a constant thickness different from the thickness $D_A$.

Also, referring to FIG. 3C illustrating a cross-sectional view taken along the line C-C parallel to the line B-B of FIG. 2, the thickness of the bottom surface 23 of the scroll-type flow path may be progressively reduced from the point $P_{C1}$ to the point $P_{C2}$, and its inclination angle may be an angle $\alpha$.

When the thickness of the bottom surface 23 of the scroll-type flow path at the cut-off region 24 ($P_{C1}$) where the scroll-type flow path 25 starts is compared with the thickness of the bottom surface 23 of the scroll-type flow path at a location adjacent to where the scroll-type flow path ends, the thickness $D_{C1}$ at the cut-off region $P_{C1}$ may be greater than the thickness at the $P_{C2}$ of a location adjacent to where the scroll-type flow path 25 ends. Also, the outer side of the bottom surface 23 of the scroll-type flow path 25 may have a maximum thickness $D_1$ at a point having a certain scroll angle with respect to the cut-off region $P_{C1}$. Here, the scroll angle may increase progressively from the cut-off region 24 in a counterclockwise direction, and the point $P_{B1}$ may be a point where the thickness of the bottom surface 23 is maximum.

On the other hand, the bottom surface 23 of the scroll-type flow path 25 may be formed by processing an inclination surface, particularly, an inclination surface having an inclination angle, the thickness of which is uniformly reduced from a thickness $D_1$. The outer side of the bottom surface 23 of the scroll-type flow path 25 may have a maximum thickness $D_1$ at a point having a certain angle with respect to the cut-off region 24, and the outer side of the bottom surface 23 of the scroll-type flow path 25 may have a minimum thickness at a point $P_{B4}$ adjacent to where the scroll flow path ends.

The flow path cross-sectional area may be more sufficiently secured at the region where the scroll-type flow path 25 ends than the cut-off region 24 where the scroll-type flow path 25 starts. Accordingly, the surging phenomenon can be reduced, and the amount of discharged air can increase. In addition, noise caused by air blowing can be reduced.

Also, there is an advantage in that the amount of air discharged through the outlet 26 can be increased only by forming an inclined bottom surface of the scroll-type flow path without increasing the total size of the fan housing 20. Particularly, this is advantageous for miniaturization of an air conditioner because the same flow rate as a normal-sized unit can be achieved with a miniaturized air blower 100.

On the other hand, the cross-sectional area of the scroll-type flow path 25 may become smallest at the cut-off region 24, and may progressively increase along the flow direction guided by the scroll-type flow path 25. The cross-sectional area of the scroll-type flow path 25 may become greatest at the region where the scroll-type flow path 25 ends. To this end, it is necessary to allow the inclination angle $\alpha$ of the bottom surface 23 of the scroll-type flow path 25 and the expansion ratio of the scroll-type flow path 25 (here, the expansion ratio may be defined as a ratio of an increase in the outer radius of the scroll-type flow path 25 to an increase in the flow direction angle of the scroll-type flow path) to have appropriate values.

FIG. 6 is a perspective view illustrating a rear surface of a bell-mouth of FIG. 5. FIG. 7 is a magnified cross-sectional view illustrating a portion D of FIG. 3A. Referring to FIGS. 6 and 7, a first rib 33 may be formed on the rear surface of the bell-mouth 30. The first rib 33 may be protruded from a curved surface portion formed on the rear surface of the bell-mouth 30 to extend in a ring-shape. Accordingly, the first rib 33 and the rim 12 may form concentric circles. The diameters of the first rib 33 and the rim 12 may have the same value.

A second rib 22 may be formed on the inner side surface to surround the rim 12. As shown in FIG. 5, the second rib 22 may be protruded from the top surface 21 of the fan housing 20 to which the bell-mouth is coupled toward the inside of the fan housing 20 to form a circular shape centered on a rotational axis C. The diameter of the second rib 22 may have a greater value than that of the first rib 33.

The protrusion length of the second rib 22 has to be limited such that a flow forcibly generated by the centrifugal fan 10 is not interfered with by the second rib 22. Preferably, the second rib 22 may not extend below the rim 12.

During the operation of the air blower 100, a difference between an air pressure in the fan housing 20 and an air pressure at the outlet of the bell-mouth 30 may be generated. Accordingly, a portion of air forcibly blown by the centrifugal fan 10 may return to the center portion of the centrifugal fan 10 along the rear surface of the bell-mouth 30.

The first rib 33 may block air flow returned along the rear surface of the bell-mouth 30 as described above.

The rim 12 that is a rotating body and the first rib 33 that is a fixed body have to be spaced from each other. However, since the gap between the rim 12 and the first rib 33 has to be minimized to prevent air flow from returning to the rear surface of the bell-mouth 30, the rim 12 and the first rib 33 may have the same diameter.

On the other hand, the second rib 22 extending from the top surface 21 of the fan housing 20 to the inner side of the fan housing 20 may also block air from returning to the rear surface of the bell-mouth 30.

In the present embodiment, a flow forcibly blown into the fan housing 20 by the centrifugal fan 10 may be primarily blocked by the second rib 22 before entering the rear surface of the bell-mouth 30, and then may be blocked again by the first rib 33 at the rear surface of the bell-mouth 30. Accordingly, a flow that flows along the rear surface of the bell-mouth 30 to be re-suctioned into the centrifugal fan 10 may be certainly blocked, and a pressure of air suctioned into the centrifugal fan 10 can be maintained at a uniform level. In addition, the amount of air discharged through the outlet 26 of the fan housing 20 can increase.

Figure 8:
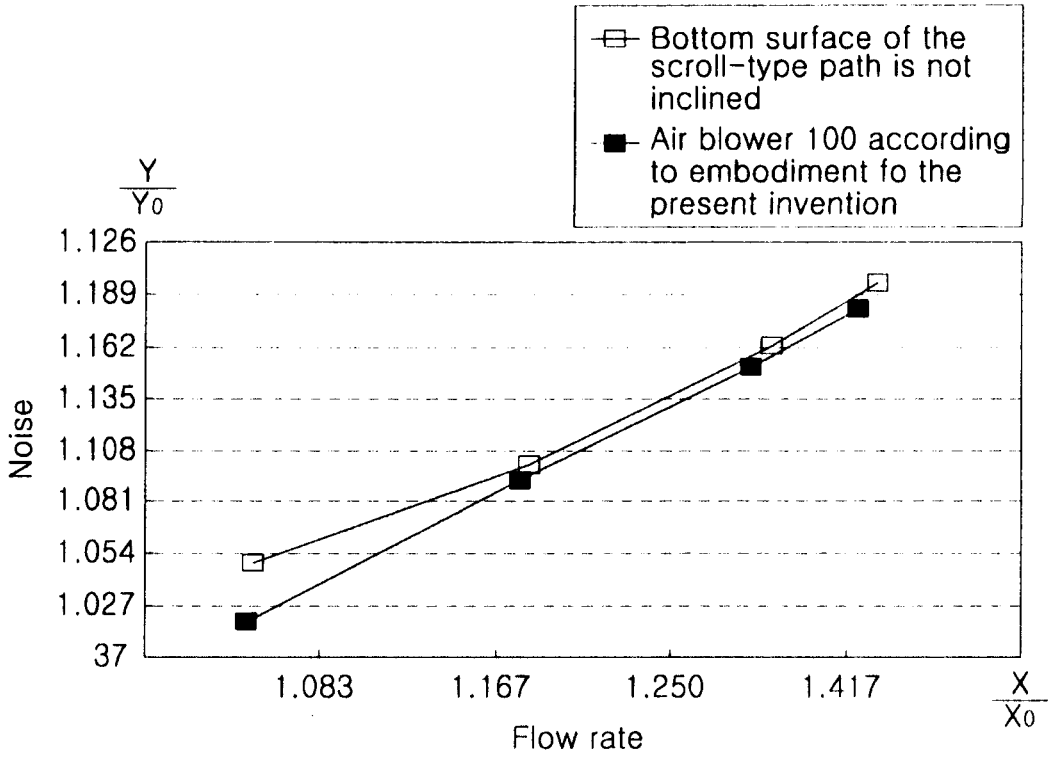
FIG. 8 is a graph illustrating a comparative example of the amount of noise between a related art air blower and an air blower according to an embodiment of the present invention.

FIG. 8 is a graph illustrating a comparative example of the amount of noise between a related art air blower in which the bottom surface 23 of the scroll-type flow path is not inclined and an air blower 100 according to an embodiment of the present invention. Here, the X-axis represents flow rate that is non-dimensionalized, and the Y-axis represents noise that is non-dimensionalized. As described in FIG. 8, when equal volumes of air are blown, noise measured in the air blower 100 according to an embodiment of the present invention is less than that measured in the related art air blower.

Since an air blower for an air conditioner according to an embodiment of the present invention has an extended flow path sectional area at the outlet of a scroll-type flow path, the amount of discharged air can increase, and noise can be reduced.

Also, an air blower for an air conditioner according to an embodiment of the present invention can reduce a surging phenomenon.

Furthermore, since an air blower for an air conditioner according to an embodiment of the present invention includes a scroll-type flow path having an inclined bottom surface, the height of a scroll-type flow path progressively increases from upstream to downstream. Accordingly, the amount of discharged air can increase by an amount corresponding to an increment of a flow path sectional area due to an increase of the height of the scroll-type flow path.

In addition, an air blower for an air conditioner according to an embodiment of the present invention has an advantage in that a flow path sectional area can be expanded at the outlet of a scroll-type flow path by a simple manufacturing method of forming a bottom surface of the scroll-type flow path by processing an inclination surface.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An air blower for an air conditioner, comprising:

a centrifugal fan; and a fan housing covering the centrifugal fan, and forming a scroll-type flow path having a varying cross-sectional area and guiding air forcibly blown by the centrifugal fan to an outlet, wherein a bottom surface of the scroll-type flow path comprises an inclined and horizontal plane wherein the inclined plane is inclined relative to the horizontal plane, wherein the bottom surface has a constant slope throughout the inclined plane, wherein a thickness of the bottom surface of the scroll-type flow path is thinnest at one region of the scroll-type flow path and is thickest at another region of the scroll-type flow path, wherein the bottom surface of the scroll-type flow path is inclined such that along a first straight line that starts where the bottom surface of the scroll-type flow path is the thinnest and ends where the bottom surface of the scroll-type flow path is the thickest, the thickness of the bottom surface of the scroll-type flow path progressively increases along the first straight line, wherein along a second straight line that crosses the first straight line, the thickness of the bottom surface along the horizontal plane is uniform.

2. The air blower for the air conditioner of claim 1, wherein a cross-sectional area of the scroll-type flow path progressively increases along the first straight line.

3. The air blower for the air conditioner of claim 1, further comprising a cut-off region of the scroll-type flow path where a portion of the airflow forcibly blown by the centrifugal fan is discharged towards the outlet and another portion of the airflow forcibly blown by the centrifugal fan is guided along the scroll-type flow path.

4. The air blower for the air conditioner of claim 1, further comprising a discharging flow path extending from a region where the scroll-type flow path ends towards the outlet, wherein the bottom surface of the discharging flow path has the same inclination angle as the scroll-type flow path.

5. The air blower for the air conditioner of claim 3, wherein the bottom surface of the scroll-type flow path has a thinner thickness at a region where the scroll-type flow path ends than a thickness at the cut-off region.

6. The air blower for an air conditioner of claim 1, wherein a height of the scroll-type flow path varies from upstream to downstream in the scroll-type flow path.

7. The air blower for the air conditioner of claim 6, wherein the height of the scroll-type flow path progressively increases from upstream to downstream in the scroll-type flow path, and an amount of discharged air increases by an amount corresponding to an increment of the flow path sectional area due to an increase of the height of the scroll-type flow path.

8. The air blower for the air conditioner of claim 7, wherein the height of the scroll-type flow path becomes greatest at a region where the scroll-type flow path ends, and is progressively reduced along a the first straight line.

9. The air blower of the air conditioner of claim 7, wherein the cross-sectional area of the scroll-type flow path progressively increases along a flow direction from a cut-off region where the scroll-type flow path starts to a region where the scroll-type flow path ends.

10. The air blower for the air conditioner of claim 6, wherein the height of the scroll-type flow path is reduced at a certain ratio along the first straight line.

11. The air blower for the air conditioner of claim 6, further comprising a discharging flow path extending from a location where the scroll-type flow path ends towards the outlet, wherein a height of the discharging flow path corresponds with the height of the scroll-type flow path.

12. The air blower for the air conditioner of claim 9, wherein at the cut-off region of the scroll-type flow path, a portion of the airflow forcibly blown by the centrifugal fan is discharged towards an outlet and another portion of the airflow forcibly blown by the centrifugal fan is guided along the scroll-type flow path.

* * * * *